US005127165A

United States Patent [19]

Polzin et al.

[11] Patent Number: 5,127,165

[45] Date of Patent: Jul. 7, 1992

[54] LEAD COMPUTING SIGHT

[76] Inventors: David H. Polzin, 2 Daybrook Close Harlaxton, Grantham, Lincolnshire NG32 1AF; Lynn Jackson, 2 Brookside, Ancaster, Grantham, Lincolnshire NG32 30 T; John E. Pike, 7 Church Lane, Sedgebrook, Grantham, Lincolnshire NG32 2EU, all of Great Britain

[21] Appl. No.: 581,718

[22] Filed: Sep. 12, 1990

[30] Foreign Application Priority Data

Sep. 12, 1989 [GB] United Kingdom ..... 8920631

[51] Int. Cl.[5] ..... F41G 3/08

[52] U.S. Cl. ..... 33/236; 33/238; 33/233; 42/101; 356/252

[58] Field of Search ..... 33/236, 237, 238, 239, 33/240; 356/255, 254, 253, 252, 251; 42/100, 101

[56] References Cited

U.S. PATENT DOCUMENTS

| | | | |
|---|---|---|---|
| 2,459,206 | 1/1949 | Wheeler | 33/238 |
| 2,467,831 | 4/1941 | Johnson | 33/236 |
| 2,570,298 | 10/1951 | Wheeler | 33/238 |
| 2,963,788 | 12/1960 | Luboshez | 33/236 |
| 4,030,839 | 6/1977 | Rickert | 356/254 |
| 4,348,109 | 9/1982 | Auterson | 356/252 |
| 4,393,597 | 7/1983 | Picard et al. | 33/236 |
| 4,404,890 | 9/1983 | McAlpine | 356/252 |
| 4,561,204 | 12/1985 | Binion | 356/21 |
| 4,671,165 | 6/1987 | Heidmann et al. | 33/252 |
| 4,695,161 | 9/1987 | Reed | 356/254 |
| 4,794,430 | 12/1988 | Whittaker et al. | 340/705 |

FOREIGN PATENT DOCUMENTS

| | | | |
|---|---|---|---|
| 2345695 | 11/1977 | France | 33/236 |

*Primary Examiner*—William A. Cuchlinski, Jr.
*Assistant Examiner*—William C. Dowling
*Attorney, Agent, or Firm*—Oblon, Spivak, McClelland, Maier & Neustadt

[57] ABSTRACT

The gun sight comprises a cathode ray tube (21) to generate an aiming image and optical means (22,23) to project said generated image into a line of sight through the gun sight. Velocity of movement of the gun sight is sensed by gyros and in response thereto the cathode ray tube (21) generates an aiming image at a location displaced from a sight-stationary position by an amount dependent on the velocity and direction of movement of the gun sight and a predetermined target range.

6 Claims, 3 Drawing Sheets

LEAD COMPUTING SIGHT

The present invention relates to a lead computing sight. More particularly, but not exclusively, it relates to a sight which enables a gunner to track attacking targets with the required lead angle offset automatically predicted.

Such sights are particularly advantageous in cases where the target is fast moving and as such find particular utility as sights for surface to air artillery.

In such sights, there is shown a crosswire display that is aimed on the target. As the gun traverses, either horizontally and/or vertically, the crosswire may be moved to have a deflection from a central point dependent on the lead angle required for any particular range, which can be calibrated beforehand.

Lead angle computing sights are known which include one or more free gyros having a mirror attached to the motor axis of the or each gyro. The crosswire is projected by means of the mirror or mirrors which must be aligned accurately to give the lead angle for a particular range. The optical systems involved in such a sight are complex, and the image produced is affected by the damping of the gyro or gyros.

It is an object of the present invention to provide a gun sight which overcomes the above disadvantage.

According to the present invention there is provided a gun sight comprising a cathode ray tube to generate an aiming image, optical means to project said generated image into a line of sight through the gun sight, means to sense velocity of movement of the gun sight and in response thereto to signal the cathode ray tube to generate the aiming image at a location displaced from a sight-stationary position by an amount dependent on the velocity and direction of movement of the gun sight and a predetermined target range.

The aiming image preferably includes a crosswire formed by an intersecting horizontal line and vertical line.

The means to sense velocity of movement may be a pair of gyros, operable about orthogonal axes, one to sense a vertical component of movement and one to sense a horizontal component of movement.

Each gyro is a rate gyro which, on sensing movement, outputs a voltage, the magnitude of which is dependent on the velocity of movement and which is fed to control means for the cathode ray tube to vary the position of the corresponding line of the crosswire.

An embodiment of the present invention will now be more particularly described by way of example and with reference to the accompanying drawings, in which.

The sight may be fitted to any weapon by means of a dovetail bore sighted to the cannon axis. It is especially suitable for weapons in the 20–35 mm calibre range, although it may be used with other calibre weapons.

Figure 1:
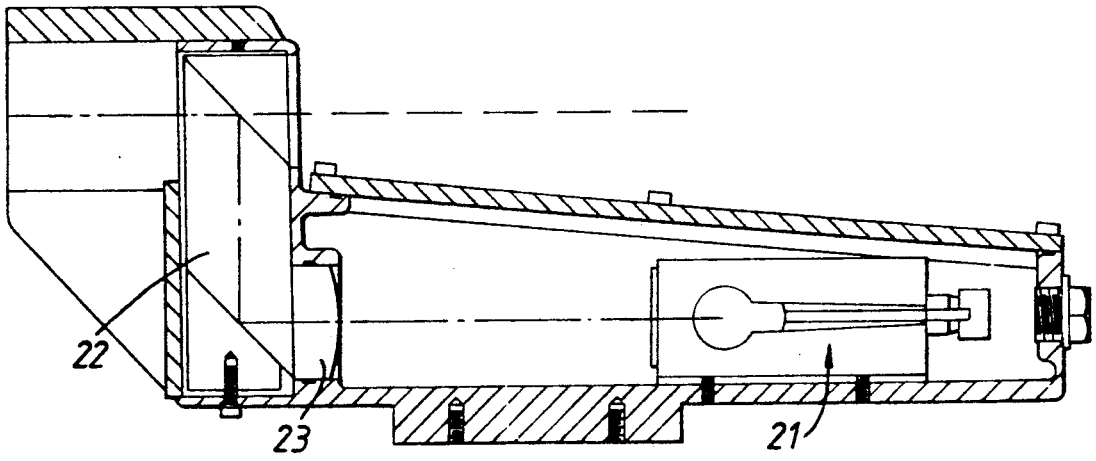
FIG. 1 is a longitudinal cross-section through a sight embodying the invention.

Referring now to FIG. 1 of the drawings, the gun sight comprises a cathode ray tube 21. This may be a 1 inch (2.5 cm) monitor set at a focal distance of 100 mm from a lens 23 and an optical prism 22 which projects the image displayed by the CRT at infinity into the sighting path.

The image generated on the monitor 21 is a crosswire formed of an intercepting vertical line and horizontal line. When the gun and therefore the sight is stationary, the crosswires appeal at a predetermined point in the sight path (see FIGS. 7 and 8), which point is generally central but need not necessarily be so. However, for convenience, it will be referred to as a central point.

When a target is picked up in the sight, it is held at the junction of the crosswires and the gun and sight moved to track the target. The movement is sensed and the position of the crosswires is moved from the central position in accordance with the speed and direction of movement.

Figure 7:
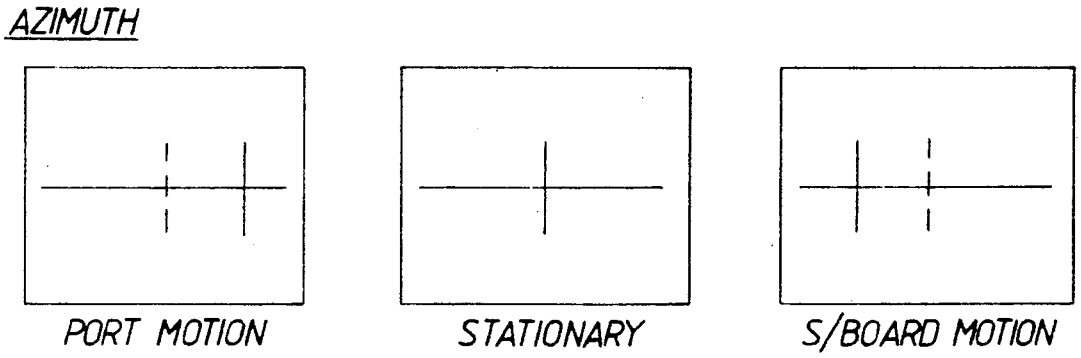
FIG. 7 shows views through the sight for motion in a horizontal plane.
Figure 8:
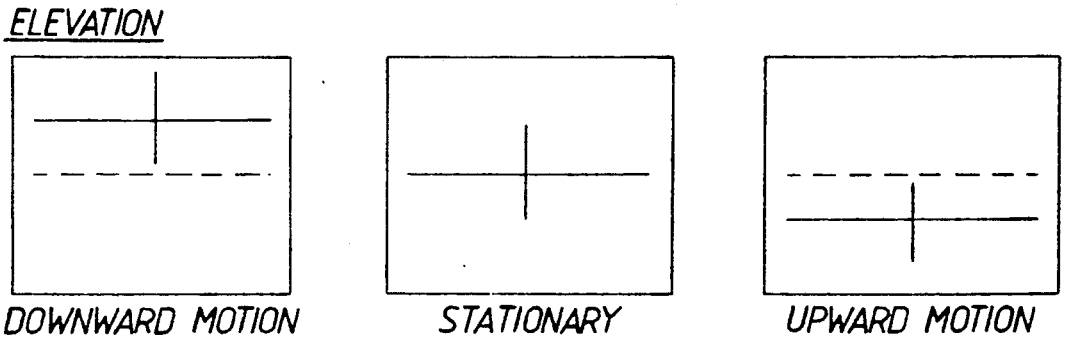
FIG. 8 shows view through the sight for motion in a vertical plane.

For example, in FIG. 7 there are shown positions for the crosswire when the sight is being moved to port, is stationary, and being moved to starboard respectively. Similarly, FIG. 8 shows a view through the sight for various directions of elevational movement. If the target is moving in a diagonal line, obviously both horizontal and vertical lines of the crosswire move accordingly.

In general, assuming smooth tracking of the target, the central point (and therefore the gun) will be spaced from the crosswire intersection by such a distance and in such a direction that a target seen at the intersection of the crosswires would be seen at the central point after a time interval allowing a shell from the gun to reach the point where is the target. This time delay period will obviously depend on range and the muzzle velocity of the gun among other factors, and these factors need to be programmed into the sight in order to make it most effective.

The rate of movement of the sight is sensed by two independent gyros, mounted at 90° one to another for azimuth and elevation sensing. The preferred gyros are each a Smiths Industries 930 RGS1 Rate Gyro which gives an output of approximately ±200 mV/deg. per sec.

Each gyro feeds directly into an Op. Amp circuit which provides offset bias, gain control and low pass filter.

Figure 2:
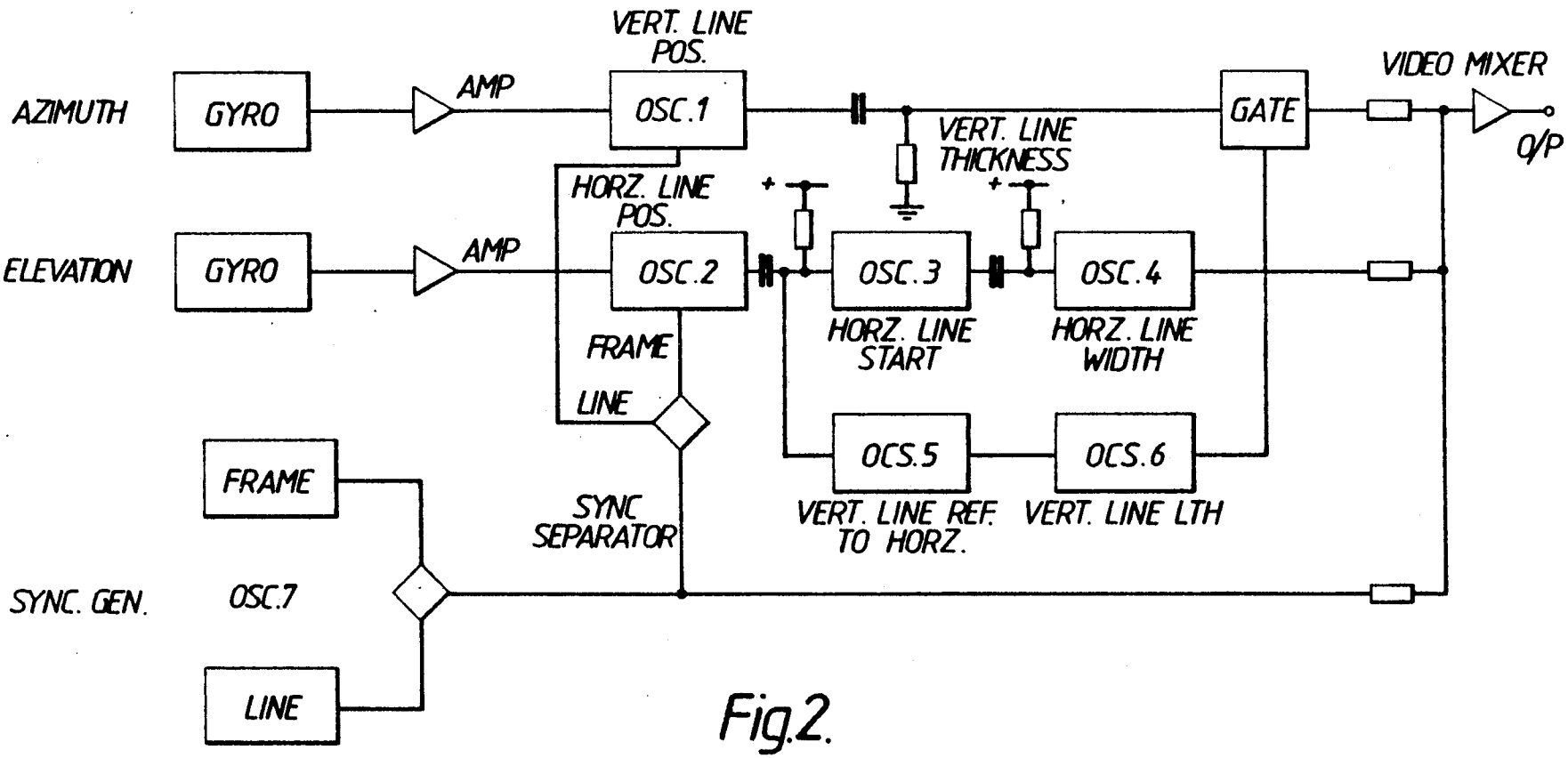
FIG. 2 is a schematic circuit diagram of a control circuit for the sight.
Figure 6:
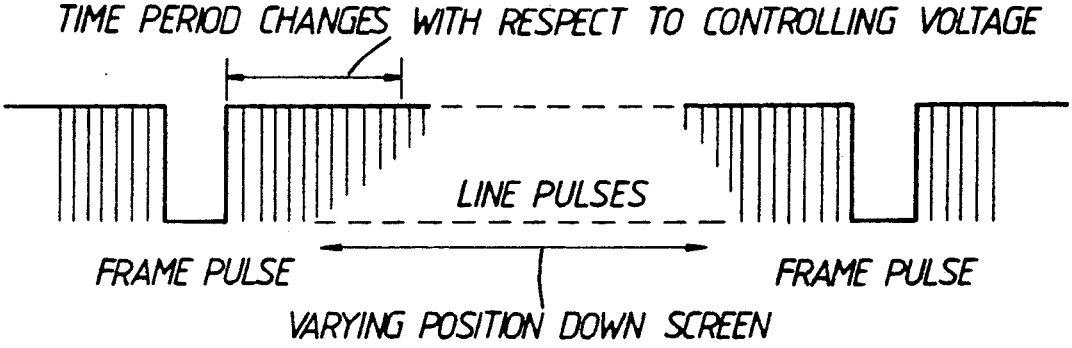
FIG. 6 shows schematically the generation of a horizontal line of the crosswire.

Referring now to FIGS. 2 and 6, the output of the elevation gyro Op. Amp provides a controlling voltage for adjusting the frequency of a horizontal line oscillator Osc. 2, which has a constant current source circuit to enable the frequency to change linearly with the changing control voltage.

In order to generate the horizontal line of the crosswires, the frame sync pulses trigger the oscillator timer Osc. 2 to generate a horizontal position and to initiate start and synchronising pulses to lock the vertical line with reference to the horizontal line. Osc. 2 triggers Osc. 3 which provides a start trigger for the horizontal line width timer Osc. 4, the output of which feeds into a video mixer.

Figure 3:
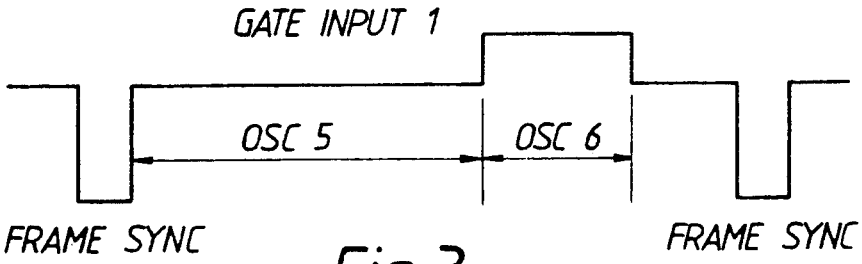
FIGS. 3 to 5 show schematically the generation of a vertical line of the crosswire.
Figure 4:
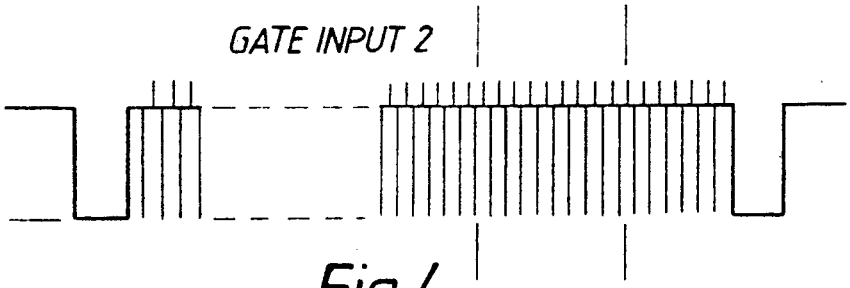
Figure 5:
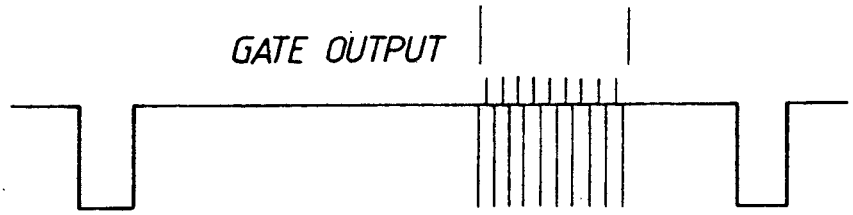

The output of the azimuth gyro Op. Amp provides a controlling voltage for adjusting the frequency of a vertical line oscillator Osc. 1, which also has a constant current source circuit. In order to generate the vertical line of the crosswires, the line sync pulses trigger Osc. 1 to a varying time period dependent on the control voltage, which represents the start of the vertical line bar, the width of which is controlled by a differentiator. The resulting output pulse inputs a gate and is switched through for a time period generated by oscillators Osc. 5 and Osc. 6. Osc. 5 is triggered by Osc. 2 to govern the position of the vertical line with reference to the horizontal line, and Osc.6, triggered by a pulse from Osc. 5, generates a pulse representative of a vertical line length. This is shown in FIGS. 3 to 5.

The gate output is then combined at the video mixer to provide a mixed composite output to interface with a standard 625 line monitor 21.

The sight is preferably self-contained and power is provided by ten 1.4 V nicad cells, or via a DC/DC converter utilising an external source of electrical power. The power source should be monitored so that a fixed crosswire display appears when voltage falls below a minimum level.

As can be seen, the sight is extremely compact with movement of the crosswires being caused by electronic input to a cathode ray tube. The image generated by the cathode ray tube moves from a central point by an amount determined by the two gyros, whereby the lead angle is automatically computed.

We claim:

1. A gun sight having a line of sight therethrough and comprising a cathode ray tube to generate an aiming image comprising a crosswire formed by intersecting horizontal and vertical lines, optical means to project said generated image into said line of sight through the gun sight, and means to sense velocity of movement of the gun sight and in response thereto to signal the cathode ray tube to generate said aiming image at a location displaced from a sight-stationary position by an amount dependent on the velocity and direction of movement of the gun sight and a predetermined target range, wherein the means to sense velocity of movement is a pair of gyros operable about orthogonal axes: a first gyro to sense a vertical component of movement and a second gyro to sense to horizontal component of movement, and wherein each gyro acts in relation to a particular corresponding line and is a rate gyro which, on sensing movement, outputs a voltage, the magnitude of which is dependent on the velocity of movement and which is fed to control means for the cathode ray tube to vary the position of the corresponding line of the crosswire.

2. A gun sight as claimed in claim 1, wherein the output of said first gyro is fed to a first oscillator to generate a start position of a horizontal line.

3. A gun sight as claimed in claim 1, wherein the output of said second gyro is fed to a second oscillator to generate start positions of said vertical line, the width of which is controlled by differentiator means.

4. A gun sight as claimed in claim 1 wherein the cathode ray tube generates said aiming image in video format.

5. A gun sight having a line of sight therethrough and comprising a cathode ray tube to generate an aiming image comprising a crosswire formed by intersecting horizontal and vertical lines, optical means to project said generated image into said line of sight through the gun sight, and means to sense velocity of movement of the gun sight and in response thereto to signal the cathode ray tube to generate said aiming image at a location displaced from a sight-stationary position by an amount dependent on the velocity and direction of movement of the gun sight and a predetermined target range, said velocity sensing means comprising a pair of gyros operable about orthogonal axes: a first gyro to sense a vertical component of movement and a second gyro to sense a horizontal component of movement, each gyro acting in relation to a particular corresponding line of the crosswire, and being a rate gyro which, on sensing movement, outputs a voltage, the magnitude of which is dependent on the velocity of movement and which voltage is fed to control means for said cathode ray tube to vary the position of the corresponding line of said crosswire, the output of said first gyro being fed to a first oscillator to generate a start position of said horizontal line, the output of said second gyro being fed to a second oscillator to generate a start position of said vertical line, and differentiator means for controlling the width of said vertical line.

6. A gun sight as claimed in claim 5 wherein the cathode ray tube generates said aiming image in video format.

* * * * *